US007708272B2

(12) United States Patent
Van Opstal

(10) Patent No.: US 7,708,272 B2
(45) Date of Patent: May 4, 2010

(54) DEVICE AND METHOD FOR FORMING A STACK OF SHEETS ON A DELIVERY SURFACE

(75) Inventor: Franciscus C. P. Van Opstal, Velden (NL)

(73) Assignee: OCE-Technologies B.V., Venlo (NL)

( * ) Notice: Subject to any disclaimer, the term of this patent is extended or adjusted under 35 U.S.C. 154(b) by 697 days.

(21) Appl. No.: 11/121,101

(22) Filed: May 4, 2005

(65) Prior Publication Data

US 2005/0248079 A1 Nov. 10, 2005

(30) Foreign Application Priority Data

May 5, 2004 (NL) ..... 1026119

(51) Int. Cl.
*B65H 31/36* (2006.01)

(52) U.S. Cl. ..... 271/221; 271/220

(58) Field of Classification Search ..... 271/3.02, 271/220, 221, 222, 306, 176, 177, 199–201, 271/223, 180, 181, 241; 270/58.12, 58.16, 270/58.17, 58.27; 414/788.9–789.1
See application file for complete search history.

(56) References Cited

U.S. PATENT DOCUMENTS 2,991,999 A * 7/1961 Doerner ..... 271/220
4,325,544 A 4/1982 Magno et al.
4,647,265 A * 3/1987 Uno ..... 414/790.2
4,874,160 A * 10/1989 Yamamoto ..... 271/227
4,949,134 A * 8/1990 Iwaki et al. ..... 399/402
5,026,034 A * 6/1991 Russel et al. ..... 271/220
5,054,766 A 10/1991 Seki et al.
5,091,754 A * 2/1992 Abe et al. ..... 399/394
5,938,192 A * 8/1999 Kosasa ..... 271/221
6,330,999 B2 * 12/2001 Coombs et al. ..... 270/58.18
6,819,906 B1 * 11/2004 Herrmann et al. ..... 399/368
7,007,946 B1 * 3/2006 Dobrindt et al. ..... 271/189
7,025,347 B2 * 4/2006 Masui et al. ..... 271/241
7,040,855 B2 * 5/2006 Schnurr ..... 414/789
7,281,708 B2 * 10/2007 Murata et al. ..... 270/58.12
7,455,291 B2 * 11/2008 Reeves et al. ..... 271/181
7,520,506 B2 * 4/2009 Dax et al. ..... 271/220
7,530,567 B2 * 5/2009 Bober et al. ..... 271/220
2002/0101030 A1 * 8/2002 Gordon et al. ..... 271/221
2004/0070141 A1 * 4/2004 Michels et al. ..... 271/220

FOREIGN PATENT DOCUMENTS

JP 58-197150 A 11/1983
JP 2004-99274 A 4/2004

* cited by examiner

*Primary Examiner*—Patrick H Mackey
*Assistant Examiner*—Jeremy Severson
(74) *Attorney, Agent, or Firm*—Birch, Stewart, Kolasch & Birch, LLP

(57) ABSTRACT

A method and device for forming a stack of sheets including a delivery surface, and also a stop and a pusher element movable in the direction of the stop, and also a guide which can occupy a first and a second position, in which the first position a sheet can be received in the guide, and in which the second position a guide path is formed, wherein the freedom of movement of the sheet edge is substantially limited in a direction substantially perpendicular to the pushing direction and substantially perpendicular to the delivery surface of the preceding sheet.

15 Claims, 10 Drawing Sheets

DEVICE AND METHOD FOR FORMING A STACK OF SHEETS ON A DELIVERY SURFACE

This application claims the priority benefit of The Netherlands Patent Application No. 1026119 filed on May 5, 2004, which is hereby incorporated by reference.

BACKGROUND OF THE INVENTION

The present invention relates to a method of forming a stack of sheets on a delivery surface which includes the steps of depositing a sheet and, with the use of a pusher element, pushing against an edge of the sheet in order to apply the sheet against a stop. The present invention also relates to a device for forming a stack of sheets using the present method said device including a delivery surface and a stop and a pusher element movable in the direction of the stop.

A method and device according to U.S. Pat. No. 5,054,766 is known wherein sheets are collected and arranged into a straight stack for after-treatment, for example, stapling, punching or stitching. A known application is the collection of printed sheets in a copying machine or printer. The collecting stations associated with such machines must be able to operate reliably at the speed of the copying machine or printer, which may be very high, for example more than 60 or even more than 100 prints per minute on A4 format. In addition, it must be possible to be able to process an ever-increasing variety of materials. The variety of materials varies from various plastic films, very thin and flimsy papers, to thick stiff papers. The gram weights of the types of paper that can be processed to modern requirements in modern printers and copying machines vary between 60 to 65 g/m$^2$ and 250 to 300 g/m$^2$. A problem that occurs with the various types of paper in use is that the deposited printed sheets do not lie absolutely flat, but may have an upwardly or downwardly directed curl, or in the case of very thin sheets may simply hang down limply. The pusher element that has to move the sheets against a stop in order to form a straight stack does not act on the front edge in such cases, but on the curled or limply hanging part of the sheet. The result is that the sheet is mainly bent, and is hardly moved, if at all, and is not straightened against the stop.

SUMMARY OF THE INVENTION

The object of the present invention is to provide a method and device which do not have these disadvantages.

The present invention provides a method wherein at least during a part of the pushing movement, the freedom of movement of the sheet edge is limited in a direction which is substantially perpendicular to the pushing direction and substantially perpendicular with respect to the delivery surface, the limitation being obtained with the use of a guide.

As a result of limiting the freedom of movement of the sheet edge by means of a guide in accordance with the present invention, the sheet cannot be deflected by the action of the pusher element but is actually moved against the stop. In this way, units which form stacks by jogging sheets against a stop can efficiently and safely handle a very wide range of receiving materials in a large variety of temperature and moisture conditions. The present invention also provides a device for performing the present method.

In one embodiment according to the present invention, the guide comprises two guide elements moving towards one another. As a result, any curl in the delivered sheets, in both the upward and downward direction, can be limited during at least part of the pushing movement, so that the sheet cannot be deflected as a result of the pusher element action but really is moved against the stop.

In another embodiment according to the present invention, the guide is controlled by the pusher element. As a result, the movement of the guide can be synchronised with the movement of the pusher element. In this way, on each pushing movement the relevant freedom of movement of the sheet edge is already sufficiently limited, so that the sheet cannot be deflected by the action of the pusher element but really is moved against the stop and damage to the surface of the sheet to be deposited on the stack due to the repeating movement of the pusher element is prevented.

In another embodiment according to the present invention, the guide is controlled by an electric drive. In this way it is possible to control the movement electronically and to act on any deviating situations during the receiving process.

In still another embodiment according to the present invention, the position of the guide path formed in the guide is adapted to the stack height. In this way, during the build-up of the stack it is always possible to ensure that any risk of damage is minimised.

In another embodiment, the two guide elements co-operate with one another by means of a spring force. As a result, the two parts can be closed in the position of rest and be opened if necessary, for example to receive a new sheet. In a further improvement, such opening is achieved by a structural element which is situated on the pusher element. In a further improvement this structural element is constructed as a leaf spring. In this way flexible opening of the guide elements can be achieved while wear of the contact surfaces between the guide elements and the structural element is prevented.

The invention also relates to a device for forming a stack of sheets, including a delivery surface, together with a stop and a pusher element movable in the direction of the stop, the device also including a guide which can occupy a first and a second position, in which first position a sheet can be received in the guide, and a second position in which a guide path is formed, wherein the freedom of movement of the sheet edge in a direction substantially perpendicular to the pushing direction and substantially perpendicular to the delivery surface of the preceding sheet, is substantially limited.

BRIEF DESCRIPTION OF THE DRAWINGS

The present invention will now be explained in detail with reference to the following drawings, wherein.

DETAILED DESCRIPTION OF THE INVENTION

Figure 1:
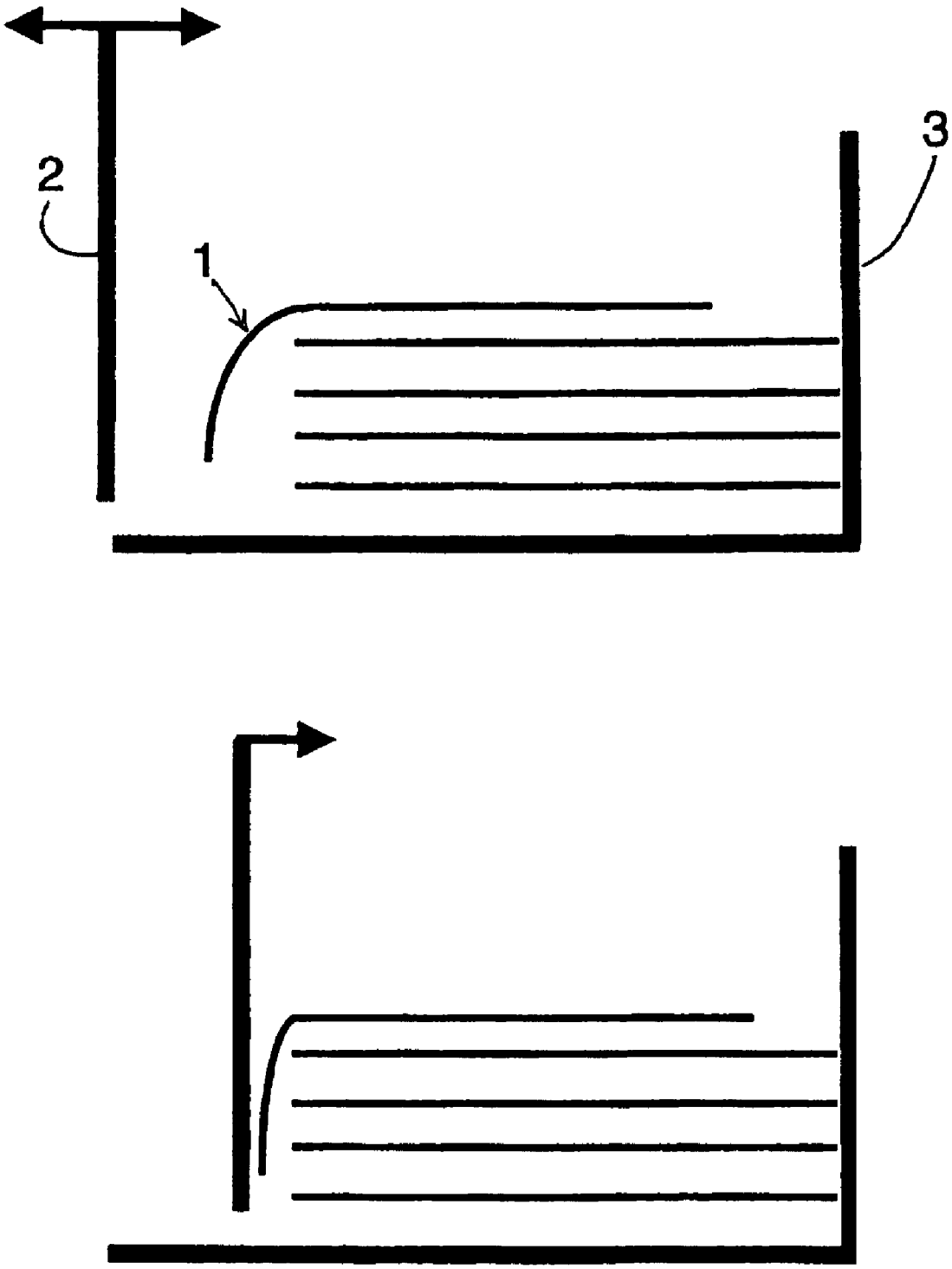
FIG. 1 shows the problem occurring in the prior art.

FIG. 1 illustrates the problem which may occur when sheets which are curled during collection are straightened for possible after-treatment or removal from the stack. As a result of the straightening or jogging of sheets which are placed on the top of a stack, thin sheets or sheets which are curled, for example due to the influence of bends in the machine paper path, or damp or temperature differences, may be incorrectly positioned against the stop and after numerous impacts may even be damaged to varying degrees and/or not be bound together with the other sheets in the stack. This effect is undesirable. This problem manifests itself particularly in systems having high capacity, high output speeds and a large variety of substrate materials. After-treatment stations must always be able to operate more rapidly and be able to handle an ever-increasing variety of materials and in practice it must be possible to change over from very thin and flimsy paper to thick and stiff paper.

Figure 2:
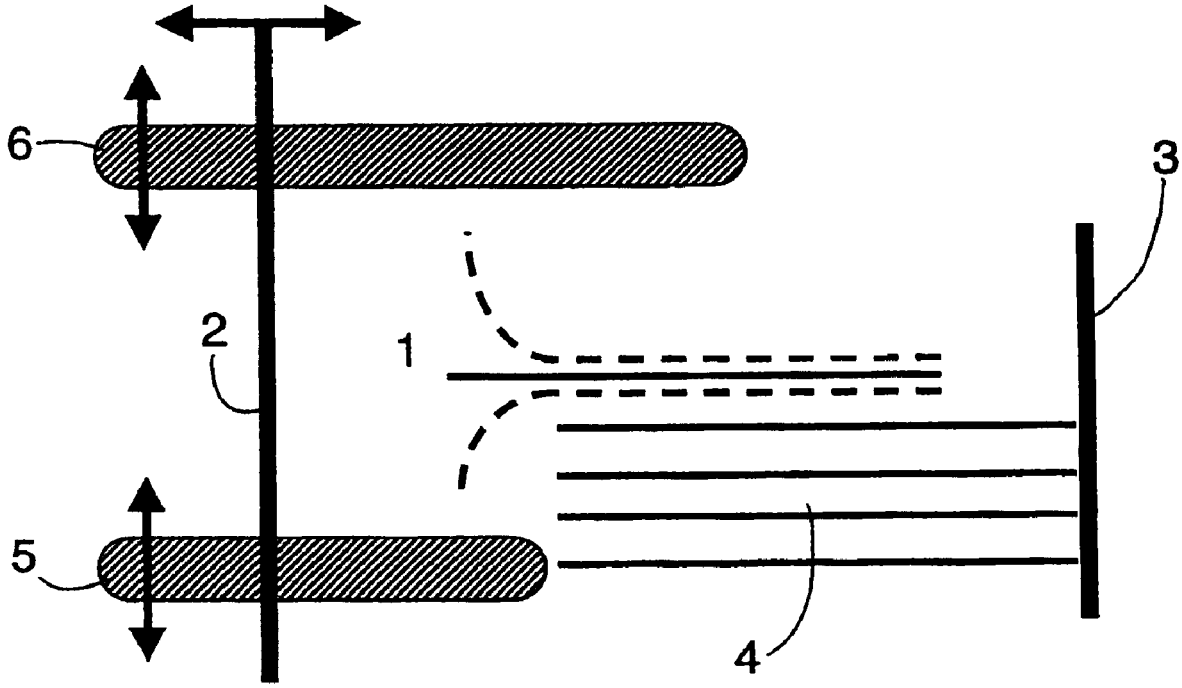
FIG. 2 is a side elevation diagrammatically showing a device according to the present invention in its initial receiving position.

FIG. 2 is a cross-section, in side elevation, of a device according to the present invention in the initial receiving state. In this state, the device is capable of receiving sheets, for example from a processing station in which an image is placed on the substrate. The sheets 1 which enter the device are placed at the top of the stack 4, but are not yet aligned. A number of different possibilities of situations that may involve a sheet on arrival are shown diagrammatically. A sheet may hang down limply from a stack, or have a downward curl due to damp conditions or temperature influences, a sheet may lie relatively straight due to reasonable stiffness or limited overhang, and a sheet may curl upwards, for example due to damp conditions or temperature influences. As illustrated in FIG. 2, the device according to the present invention includes a pair of elements 5, 6 which, by moving towards one another, can restrict the freedom of movement of a sheet of paper 1, and a jogging element 2 which can make a movement from its initial receiving position in the direction of the register wall 3.

Figure 3:
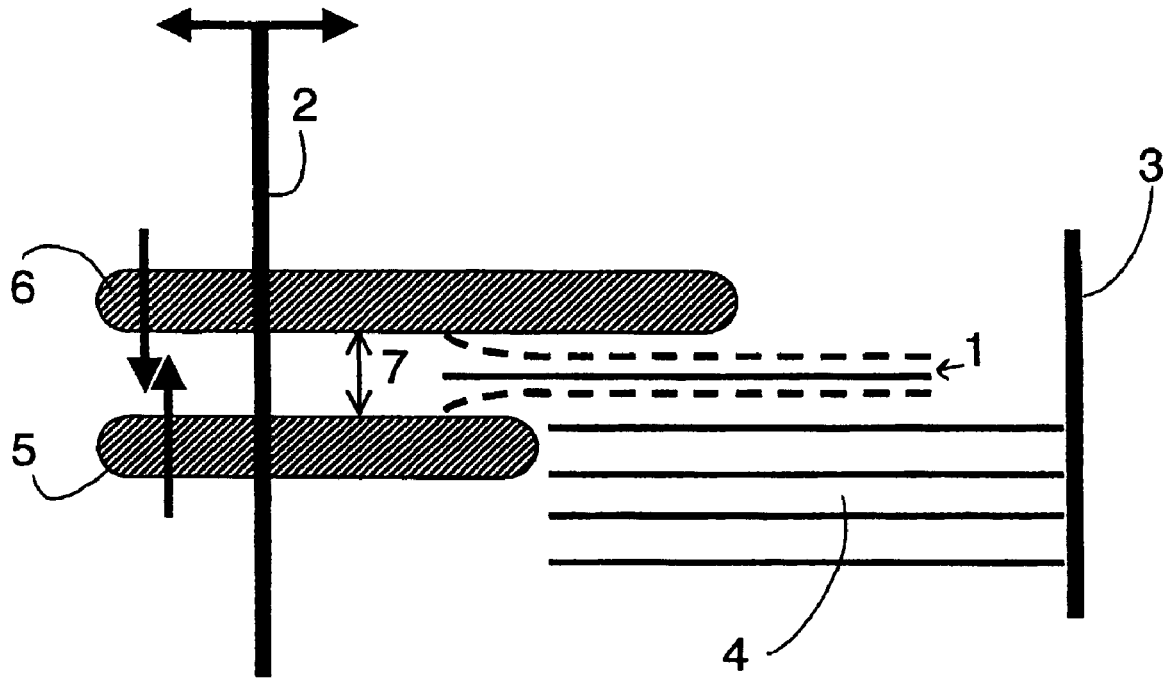
FIG. 3 is a diagram showing the limiting position of the device of FIG. 2.

As shown in FIG. 3, as a result of moving the bottom guide element 5 and the top guide element 6 towards one another, a narrow guide path 7 is formed. The freedom of movement of a sheet 1 for alignment is thus so restricted by the guide path 7 that effects such as are shown in FIG. 1 will not occur when the jogging element 2 makes its jogging movement toward register wall 3.

Figure 4:
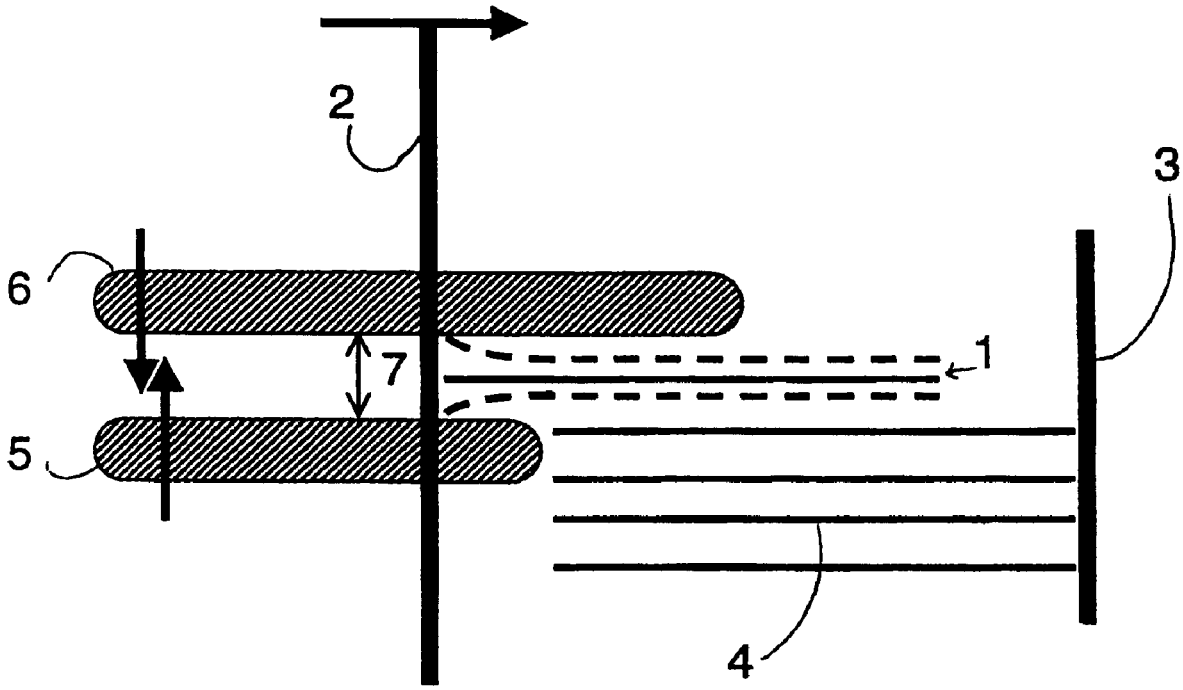
FIG. 4 diagrammatically shows the jogging movement of the device of FIG. 2.

FIG. 4 illustrates how the sheet 1 enclosed by the guide elements 5, 6 is pushed, by the movement of the jogging element 2 in the narrow guide path 7, in the direction of the register wall 3. It will be clear that the freedom between the guide elements 5, 6 in the narrow guide path 7 must be so selected that curl in the sheet 1 is sufficiently restricted in order not to cause a crease in sheet 1, but has sufficient freedom to move in the direction of the register wall 3. By positioning the guide element 5 sufficiently close to the stack, it is even possible for sheets 1, which hang down to a considerable degree, to be received in the narrow guide path 7. By making the length of the top guide element 6 sufficiently long so that it extends over the edge of the stack, it is not only possible to trap more extensive curling in the sheet 1, but also, as a result, scan the actual height of the stack 4 so that the narrow guide path 7 can adjoin the actual height of the stack 4 so that any damage to the image can be further prevented.

Figure 5:
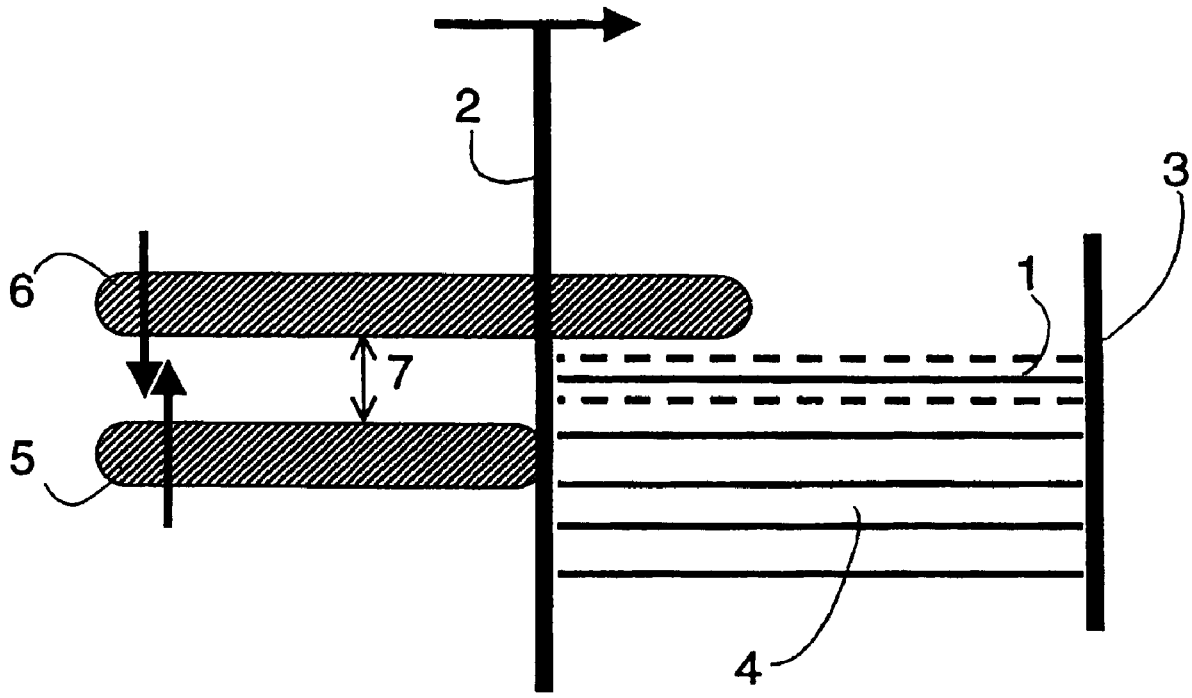
FIG. 5 is a diagram showing the jogged state of the device of FIG. 2.
Figure 6:
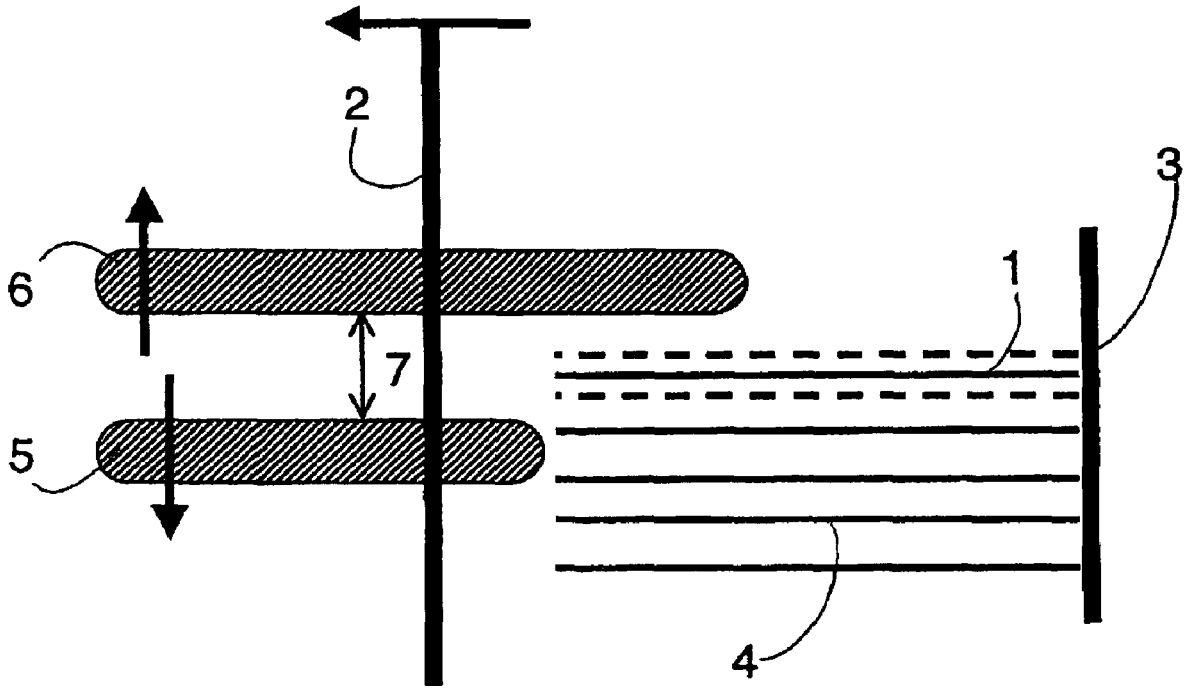
FIG. 6 is a diagram showing the return movement of the device of FIG. 2.

FIG. 5 is a diagram showing an extreme position of the device according to the present invention, in which the jogger has reached its end position near the edge of the stack. In this position, the last sheet 1 placed on the stack has been pushed against the register wall 3, so that it forms part of the stack 4 aligned against the register wall and the device can move back as shown in FIG. 6 to its initial position in which a new sheet can again be received. After straightening, there may still be some curl present in the sheet. During the return movement as shown in FIG. 6, the jogger 2 and the guide elements 5, 6 move back to their initial position, so that sufficient space is formed to receive a new sheet.

Figure 7:
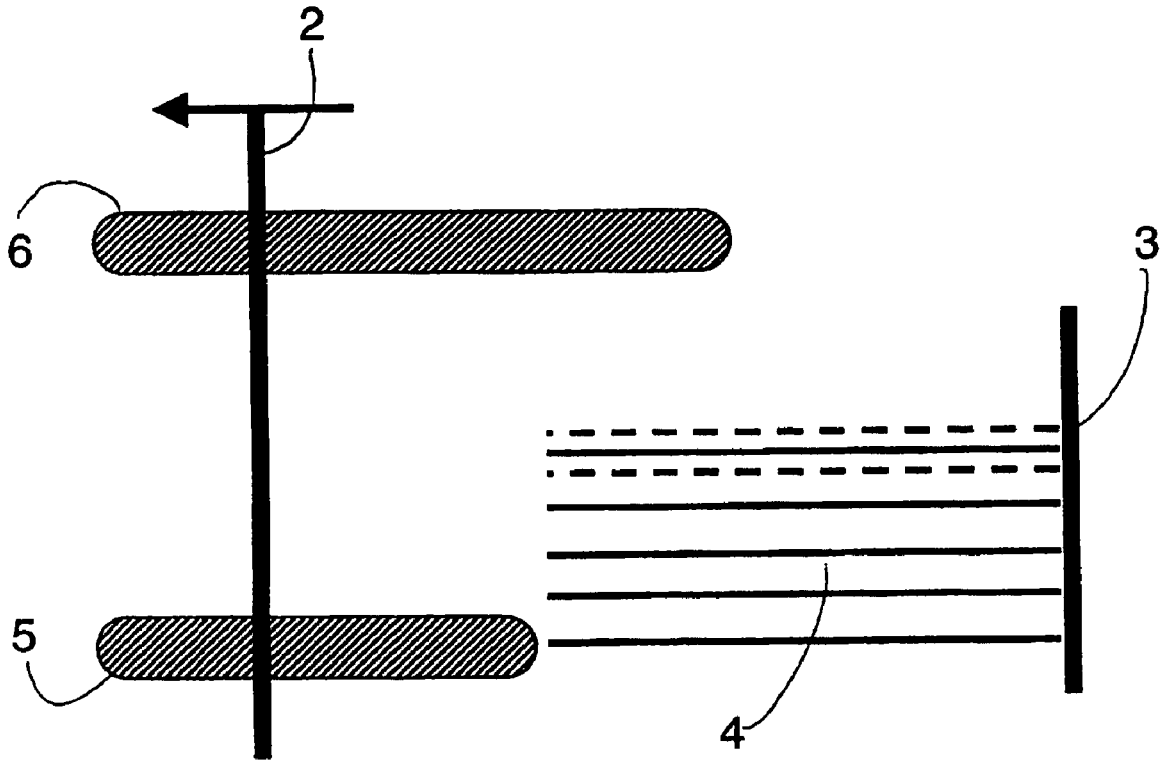
FIG. 7 diagrammatically illustrates the return to the initial receiving position of the device of FIG. 2.

FIG. 7 shows how the device returns to its initial receiving position. After a new sheet has been received, the device will again move in order to align this sheet on the stack against the register wall. So that a set may be complete, any after-treatment can be carried out on the aligned set, and then the set can be removed.

It will be apparent that the movement of the jogger element can be embodied in various ways according to the character of the movement. Thus a rectilinear movement can be obtained, for example, by means of a direct or indirect electric drive, utilizing a cam disc and a cam follower.

The movement of the guide elements can also be embodied in a known manner, for example by means of a direct or indirect electric drive or by a construction which utilizes a cam disc and follower. The movement of the guide elements can also be controlled by the movement of the jogger element. In this way, a synchronization can be obtained between the jogging element and the movement of the guide elements, so that the entire movement cycle can progress in synchronism, for example, with the entry of new sheets.

It will be clear to one skilled in the art that where reference is made to a delivery surface this does not in all cases mean a completely flat unit. Even if the delivery surface is provided with grooves, perforations or the like, a delivery surface is always formed, for example, over the tops of any groove ridges which may be present.

Figure 8:
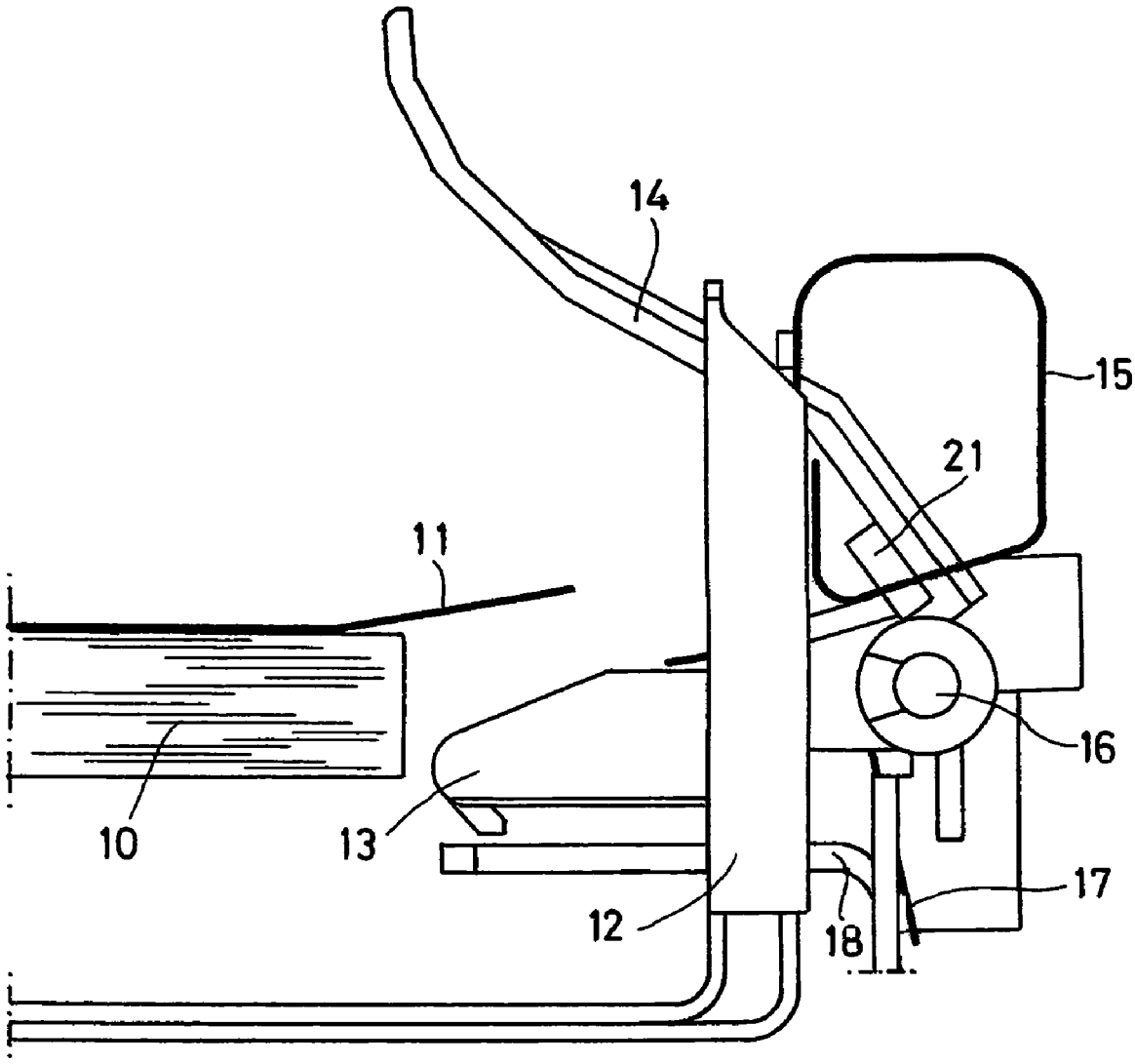
FIG. 8 is an embodiment of a device according to the present invention in the receiving position.

FIG. 8 shows one embodiment of the device according to the present invention in which the device is in the receiving position. In the receiving position, the jogger element 12 is in its end position, so that a first yoke 15 forces the bottom guide element 13 into its bottom end position and a second yoke forces the top guide element 14 into its top end position. This results in an open position between the two guide elements 13, 14, so that a new sheet can be received in co-operation with the end position of the jogger element 12.

Figure 9:
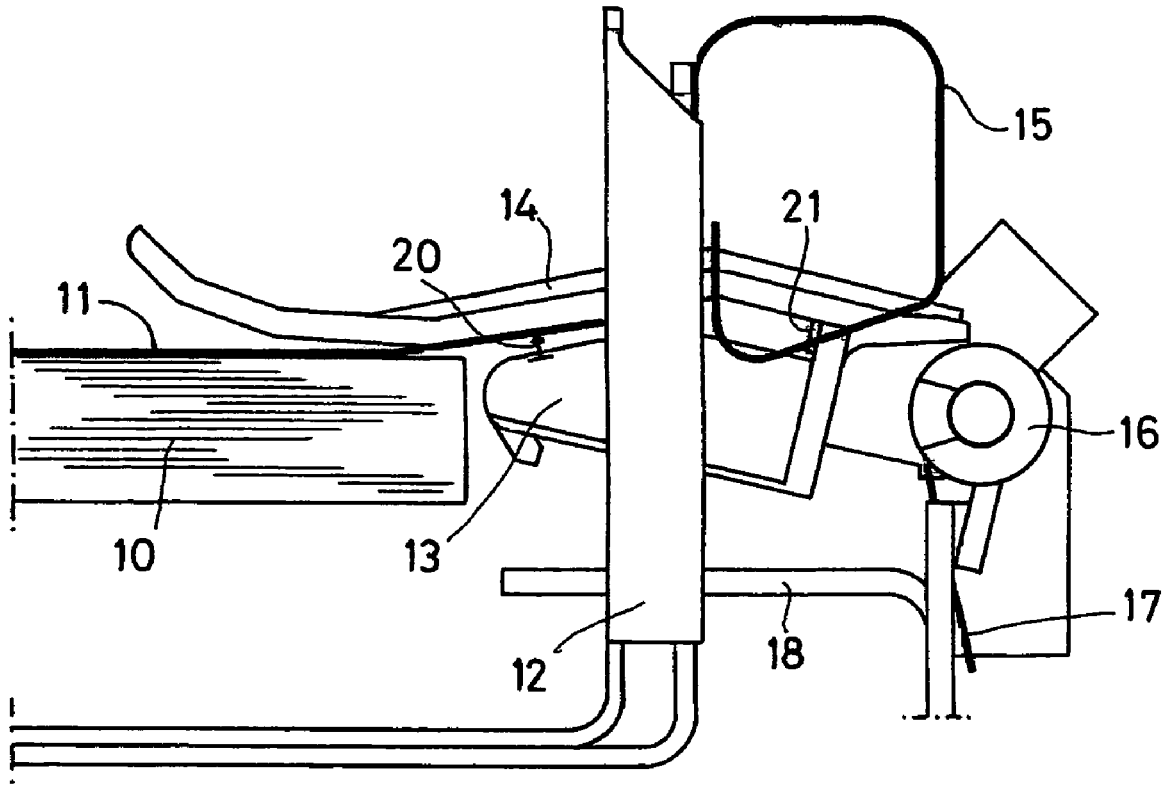
FIG. 9 shows the device of FIG. 8 in the closed position.

FIG. 9 shows how the device of FIG. 8 transitions into a closed position in accordance with the above-described synchronization. The jogger element 12 then pushes the new sheet 11 on to the stack 10. The rectilinearly moving jogger element 12 is provided with a first and a second yoke 15. Under these conditions, a new guide path 20 is formed by the two guide elements 13, 14 which are rotatably mounted with respect to one another on the frame 18 of the device. A torsion spring 17 disposed between the two guide elements 13, 14 provides a spring force which tends to close the guide elements 13, 14. A spacer 21 disposed between the two guide elements 13, 14 ensures that there is sufficient freedom between the guide elements 13, 14 to form a narrow guide path 20 in which the enclosed sheet 11 can be moved in the direction of the register wall. As a result, the bottom guide element 13 will follow the top guide element 14 at a constant distance when the yokes 15, mounted on the jogging element 12, do not force the guide elements 13, 14 into an open position. Since the top guide element 14 is sufficiently long to extend over a part of the stack 10 and the bottom guide element 13 follows the top guide element 14, the narrow guide path 20 moves with the height of the stack 10, so that sheets 11 do not experience any obstruction from a varying stack height during the build-up of the stack 10.

Figure 10:
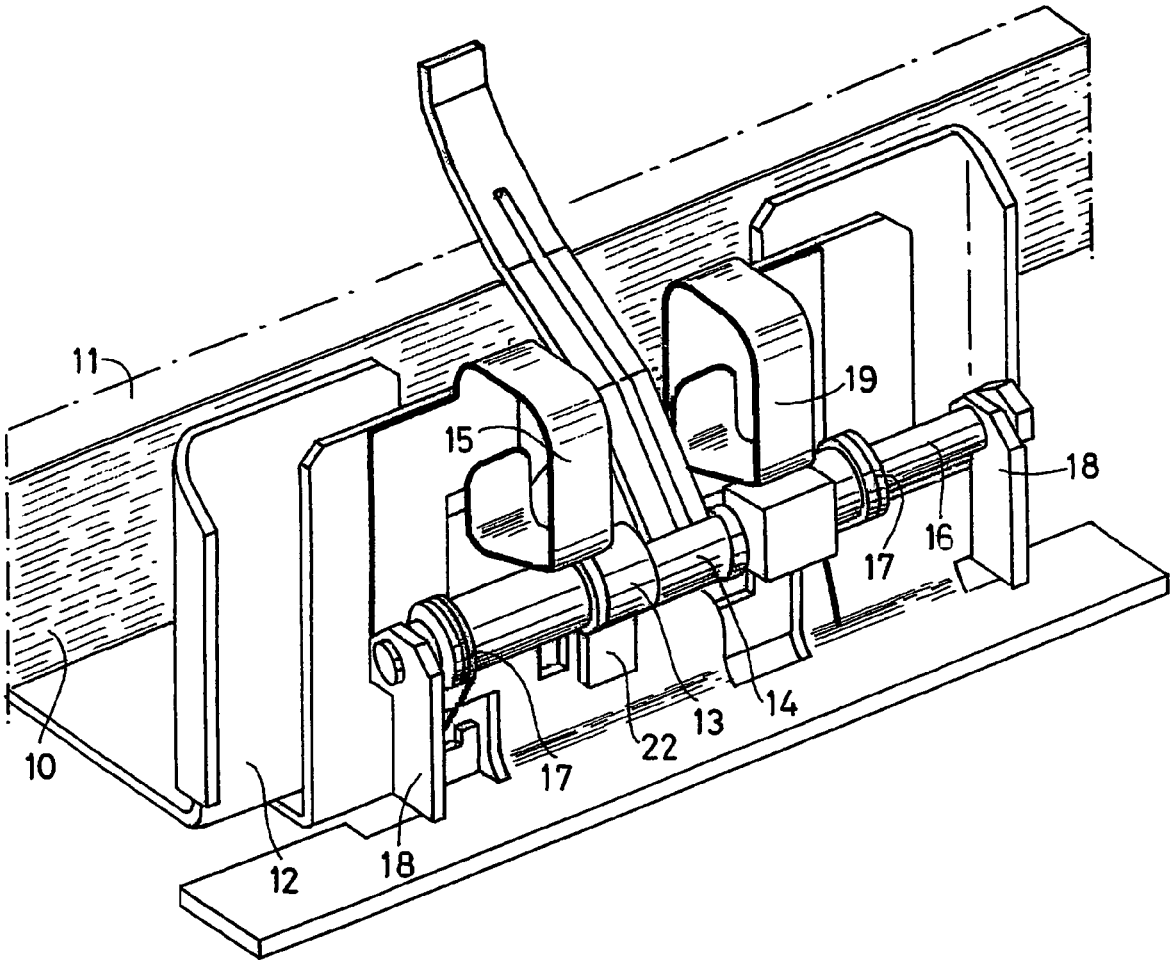
FIG. 10 is a three-dimensional view of the device shown in FIG. 8.

FIG. 10 shows how the guide elements 13, 14 co-operate by spring force, which is generated by a torsion spring 17 mounted around the rotational shaft 16. The yokes 15 and 19 mounted on the jogger element 12 press the bottom guide element 13 down and hold the top guide element 14 up, respectively, against the torsion spring force. When the jogger element 12 moves in the direction of the abutment, the yokes 15 and 19 which in this case are constructed as curved leaf springs will lose contact with the two guide elements 13, 14 so that the bottom guide element 13 will move along the stack 10 towards the sheet 11 to be enclosed, and the top guide element 14 will move along the top edge of the stack 10 including the sheet 11 to be enclosed. The bottom guide element 13 is provided with a contact surface at the rotational shaft so that on contact with yoke 15 a controlled closing movement will occur. The movement to the closed position is relatively limited by the position of the top guide element 14 and limited absolutely by the frame 18 which limits the end position of the limiting element 22.

It will be clear to one skilled in the art that the choice of the height for the guide path 20 in the device according to the present invention depends on the paper which is used. In the embodiment represented here, a wide range of types of material can be used. The height of the guide path must not be made too large, since then the freedom of movement of the edge of thin sheets will not be sufficiently limited. Nor must the height be made too small, since then the sheets will jam during the jogging movement. It will be clear that a number of simple tests can readily determine the minimum height of the guide path. In this embodiment, good results are obtained with a height for the guide path of between 0.1 and 5 mm. Preferably, between 0.5 and 2 mm. In the embodiment illustrated, a height of 1 mm has been selected.

The choice of geometry for the guide elements 13, 14 depends on the application. A good result is obtained by arranging for at least a part of the two guide elements 13, 14 to extend in parallel relationship to one another, so that a substantially parallel guide path 20 is obtained. By rounding the top guide element 14 off somewhat at the surface of contact with the paper, it is possible to prevent the top sheet 11 of the stack 10 from being damaged during the cyclic movement of the guide element 14. By then making an extra rounding at the end of said guide element 14 it is possible to prevent the end of said guide element from jamming beneath the flat plate, possibly disposed on the receiving surface, and causing damage.

By rounding off the end of the bottom guide element 13 it is possible to prevent the guide element 13 from jamming in the already aligned stack 10 during the upward movement, something which would destroy the order of the stack 10. The bottom guide element 13 is also rounded off at the side where the sheets 11 enter, so that sheets 11 can move easily over the guide element 13 upon reception.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of forming a stack of sheets on a delivery surface which comprises depositing a sheet on the delivery surface, and pushing against an edge of the sheet to move the sheet against a stop wherein at least during a part of the pushing operation, the sheet is guided by two guide elements which are caused to move towards each other during the pushing operation such that the freedom of movement of the sheet edge is limited in a direction which is substantially perpendicular to the pushing direction and substantially perpendicular with respect to the delivery surface, wherein the sheet has a top surface and a bottom surface, and the two guide elements move toward each other during the pushing operation such that one of the two guide elements moves in a direction substantially perpendicular to the top surface and the other one of the two guide elements moves in a direction substantially perpendicular to the bottom surface.

2. The method according to claim 1, wherein the guide elements are controlled by the pushing operation.

3. The method according to claim 1, wherein the guide elements are controlled by an electric drive.

4. The method according to claim 1, wherein the guiding of the sheet defines a guide path and the position of the guide path is adapted to the height of the stack.

5. The method according to claim 4, wherein the freedom of movement on at least two sides of the sheet edge is limited by the guide path.

6. The method according to claim 1, wherein the two guide elements co-operate with one another by spring force.

7. The method according to claim 1, wherein the guide elements are moved into an open position by a structural element operatively associated with the pushing operation.

8. A method of forming a stack of sheets on a delivery surface which comprises depositing a sheet on the delivery surface, and pushing against an edge of the sheet to move the sheet against a stop wherein at least during a part of the pushing operation, the sheet is guided by two guide elements which are caused to move towards each other during the pushing operation such that the freedom of movement of the sheet edge is limited in a direction which is substantially perpendicular to the pushing direction and substantially perpendicular with respect to the delivery surface, wherein the guide elements are moved into an open position by a structural element operatively associated with the pushing operation, and wherein the structural element is constructed as a leaf spring.

9. A device for forming a stack of sheets, the device comprising:

a delivery surface, a stop and a pusher element movable in the direction of the stop, and a guide system comprising a first and a second guide element, which are adapted to occupy a first and a second position and adapted to move between said first and a second position, wherein in said first position a sheet is received in the guide system, and in said second position a guide path for the sheet is defined, whereby the freedom of movement of the sheet edge in a direction substantially perpendicular to the pushing direction and substantially perpendicular to the delivery surface of a preceding sheet, is substantially limited, wherein the sheet has a top surface and a bottom surface, and the first and second guide elements are configured to move toward each other such that one of the first and second guide elements moves in a direction substantially perpendicular to the top surface and the other one of the first and second guide elements moves in a direction substantially perpendicular to the bottom surface, and wherein the first guide element co-operates with the second guide element by spring force.

10. The device according to claim 9, wherein the position of the guide elements is controlled by the pusher element.

11. The device according to claim 9, wherein the position of the guide elements is controlled by an electric drive.

12. The device according to claim 9, wherein the position of the guide path depends on the height of the stack.

13. The device according to claim 9, wherein the position of the second guide element follows the position of the first guide element in defining the guide path.

14. The device according to claim 9, wherein the freedom of movement on at least two sides of the sheet edge is limited by said guide path.

15. A device for forming a stack of sheets, the device comprising:

a delivery surface, a stop and a pusher element movable in the direction of the stop, and a guide system comprising a first and a second guide element, which are adapted to occupy a first and a second position and adapted to move between said first and a second position, wherein in said first position a sheet is received in the guide system, and in said second position a guide path for the sheet is defined, whereby the freedom of movement of the sheet edge in a direction substantially perpendicular to the pushing direction and substantially perpendicular to the delivery surface of a preceding sheet, is substantially limited, wherein the first guide element is disposed above the sheet and the second guide element is disposed below the sheet, said first guide element being longer than said second guide element.

* * * * *